US008509468B2

(12) United States Patent
van Halteren et al.

(10) Patent No.: US 8,509,468 B2
(45) Date of Patent: Aug. 13, 2013

(54) APPARATUS FOR OUTPUTTING SOUND COMPRISING MULTIPLE RECEIVERS AND A COMMON OUTPUT CHANNEL

(75) Inventors: Aart Zeger van Halteren, Hobrede (NL); Sietse Jacob van Reeuwijk, Haarlem (NL)

(73) Assignee: Sonion Nederland BV, Hoofddorp (NL)

( * ) Notice: Subject to any disclaimer, the term of this patent is extended or adjusted under 35 U.S.C. 154(b) by 581 days.

(21) Appl. No.: 12/482,725

(22) Filed: Jun. 11, 2009

(65) Prior Publication Data

US 2010/0067730 A1 Mar. 18, 2010

Related U.S. Application Data

(60) Provisional application No. 61/098,120, filed on Sep. 18, 2008.

(51) Int. Cl.
*H04R 25/00* (2006.01)

(52) U.S. Cl.
USPC ..... 381/355; 381/337; 381/339; 381/345; 381/335; 381/336

(58) Field of Classification Search
USPC ..... 381/396, 386, 398, 335, 355
See application file for complete search history.

(56) References Cited

U.S. PATENT DOCUMENTS

| | | | | |
|---|---|---|---|---|
| 4,063,050 | A * | 12/1977 | Carlson et al. | 381/113 |
| 4,450,930 | A * | 5/1984 | Killion | 181/158 |
| 5,068,901 | A * | 11/1991 | Carlson | 381/325 |
| 6,798,891 | B1 | 9/2004 | Sadai et al. | |
| 6,853,735 | B2 * | 2/2005 | Imahori et al. | 381/418 |
| 2002/0106097 | A1 | 8/2002 | Danley | |
| 2005/0129258 | A1 | 6/2005 | Fincham | |
| 2006/0088176 | A1 | 4/2006 | Werner, Jr. | |
| 2006/0133636 | A1 | 6/2006 | Harvey | |
| 2006/0159298 | A1 * | 7/2006 | von Dombrowski et al. | 381/330 |
| 2008/0049959 | A1 | 2/2008 | Yang | |
| 2008/0063223 | A1 | 3/2008 | van Halteren et al. | |
| 2008/0101640 | A1 | 5/2008 | Ballad | |
| 2008/0170732 | A1 | 7/2008 | Nielsen | |
| 2008/0212805 | A1 | 9/2008 | Fincham | |

FOREIGN PATENT DOCUMENTS

| | | | |
|---|---|---|---|
| EP | 1795160 | A1 | 7/2005 |
| EP | 1871141 | | 12/2011 |
| WO | 2006083834 | A2 | 8/2006 |
| WO | 2007115304 | A2 | 10/2007 |
| WO | 2008054921 | A2 | 5/2008 |

OTHER PUBLICATIONS

Partial European Search Report for Application No. 09162475.9, Dated Nov. 27, 2012 (10 pages).

* cited by examiner

*Primary Examiner* — Davetta W Goins
*Assistant Examiner* — Jasmine Pritchard
(74) *Attorney, Agent, or Firm* — Nixon Peabody LLP

(57) ABSTRACT

A receiver or loudspeaker having a plurality of sound generators each having a housing and a sound output. An oblong channel is formed by a channel-forming element and parts of the housings. The sound outputs are positioned on one side of a middle of the channel and a outlet of the channel is positioned on the other side of the middle of the channel so that the channel has a length adapted to acoustically alter the sound. The use of the housings for forming the channels provides a more compact structure.

19 Claims, 4 Drawing Sheets

APPARATUS FOR OUTPUTTING SOUND COMPRISING MULTIPLE RECEIVERS AND A COMMON OUTPUT CHANNEL

RELATED APPLICATION DATA

This application is a nonprovisional application of U.S. Provisional Application No. 61/098,120, filed Sep. 18, 2008, which is incorporated herein by reference.

FIELD OF INVENTION

The present invention relates to an apparatus for outputting sound from multiple sound generators as well as an apparatus with a compact design.

BACKGROUND OF THE INVENTION

Apparatus of this type may be seen in, for example, US Publication No. 2008/0063223, WO 2008/054921, US Publication No. 2008/0170732, WO 2006/083834, US Publication No. 2006/0159298, US Publication No. 2006/0088176, EP 1795160, and WO 2007/115304.

Hitherto, when providing multiple receiver systems in e.g. hearing aids, a tubing or spout is desired for providing additional acoustical filtering of the output sound in order to, for example, provide the filtering brought about by the head shape of the person when a user having normal hearing listens to a sound. This filtering is not automatically provided when using a hearing aid.

Without such tubing or spouts, the so-called second peak is usually above or close to 10 kHz. In a number of desired applications, this peak preferably is somewhere between 4 and 7-8 kHz. By creating the tubing between the two single receivers, the second peak can be created again.

SUMMARY OF THE INVENTION

In a first aspect, the invention relates to an apparatus for outputting sound, the apparatus comprising a plurality of sound generating means and a channel-forming element. The plurality of sound generating means each have a housing and a sound output. The channel-forming element has one or more surface parts defining, together with one or more outer surface parts of the housings of the sound generating means, a channel having an output. The sound outputs are positioned so as to open into the channel. The channel is oblong. The sound outputs and the channel output are positioned on either side of a middle of the channel along a longitudinal axis thereof.

In the present context, a sound generating means may be any type of sound generating means, such as a loud speaker. In a particularly interesting embodiment, the sound generating means may be a so-called receiver, which may be a miniature transducer or sound generator for use in hearing aids or the like. This type of generator may be based on any technology, such as moving armature, electret and/or moving magnet.

Normally, the term miniature transducer designates a small or sub-miniature transducer such as one having an extension, in the plane of the diaphragm, of less than 7.0×5.0 mm or less than 5.0 mm×4.0 mm, such as 3.5 mm×3.5 mm, or even more preferably less than 3.0 mm×3.0 mm. Alternatively or additionally, a miniature transducer may comprise a so-called MEMS-based transducer element which is a transducer element wholly or at least partly fabricated by application of Micro Mechanical System Technology. The miniature transducer element may comprise a semiconductor material such as silicon or gallium arsenide in combination with conductive and/or isolating materials such as silicon nitride, polycrystalline silicon, silicon oxide, and glass. Alternatively, the miniature transducer element may comprise solely conductive materials such as aluminium, copper etc., optionally in combination with isolating materials like glass and/or silicon oxide.

Naturally, the transducer/receiver may also be used in larger applications such as in mobile telephones or PDA's.

Normally, each sound generator is a stand-alone sound generator adapted to receive a signal, typically an electrical signal, and output through the output sound corresponding to the signal received. In the present context, a stand-alone sound generator comprises, within the housing, both a diaphragm and means for driving the diaphragm on the basis of the received signal. Normally, a stand-alone sound generator has only one opening, i.e. the sound output. In this regard, the below mentioned vent is not taken as an opening in that it is designed to not transport sound.

The use of multiple sound generators may be due to a number of reasons, such as the desire of obtaining a larger sound intensity than that provided by a single sound generator, or the use of different types of sound generators (or different uses of the same type of sound generator) in order to obtain a desired sound or desired sound characteristics. In one example, the transducers are used for generating sound in different frequency ranges (such as a tweeter and a woofer), which sounds are subsequently combined to generate the desired sound.

In the present context, any plurality of sound generators may be used, such as 2, 3, 4, 5, 6, 7, 8, 9 or more sound generators.

It should be noted that the present sound generator may as well be a sound detector, such as a microphone. All below discussions of the acoustic properties of the channel are equally valid for sound propagating from the surroundings of the sound detectors via the channel.

Preferably, the surface part(s) of the channel-forming element are internal surface part(s), where internal means that the surface part(s) do not form part of an outer circumference of the channel-forming element when projected onto a plane. In one example, the channel-forming element is U-shaped, where the surface part(s) inside the "U" aid in defining the channel. In this situation, the "U" may be provided between two receivers having two opposed, at least substantially parallel surface parts between which the U-shaped channel-forming element is positioned.

The channel may have any effect and may be provided for a number of purposes. In the situation of the hearing aids, a tube or spout often has been provided for providing a desired acoustic post-treatment of the sound output of the receiver, as well as for interconnecting the receiver to elements guiding the sound toward the ear drum of the person. This spout, however, takes up space in the very little space available within an ear of the person. This post treatment may be handled by the present channel.

Part of the inner surface of the channel is preferably defined by outer surface parts of the sound generating means. This has a number of advantages, one being the obvious reduction in material for the channel-forming element. Another advantage may be seen when the channel extends parallel to the sound generating means, as this set-up may provide a more compact apparatus.

In order for the channel to function, the sound outputs of the sound generators are positioned so as to open into the channel. Depending on the set-up, these sound outputs may be provided at different positions in relation to the remainder of the channel and the output thereof. Preferably, the sound outputs of the sound generators are positioned in or adjacent to surface part(s) defining the channel.

According to the invention, the channel is oblong and the sound outputs and the channel output are positioned on either side of a middle of the channel along a longitudinal axis thereof. In this manner, a major part of the channel may be used for providing acoustic properties to the sound. In addition, the channel may extend along a longitudinal axis of the sound generator(s), whereby a more compact design may be obtained. Preferably, along the longitudinal direction, a distance between the outputs of the housings and the channel output is 30% or more of a length of at least one of the housings along that direction. Naturally, the one or more outer surface parts of the housings forming part of the channel may extend along the longitudinal direction of the channel from the sound outputs to the channel output or at least a major part thereof.

One use of the channel may be seen in an embodiment further comprising a tuning element adapted to be positioned within the channel. The tuning element is adapted to alter sound characteristics of the channel when positioned therein. Different sound characteristics may be obtained by using different dimensions of the tuning element. In one situation, the tuning element may alter a width or height of the channel, either along a full length of the channel or at one or more predetermined positions along the channel. Naturally, this tuning element may be removably fixed in the channel, so that different tunings may be used simply by replacing one tuning element with another tuning element with different dimensions.

In another embodiment, the channel is oblong and has a cross-section. The apparatus further comprises a sealing element comprising a flexible element. The sealing element covers the cross-section of the channel and the flexible element extending at an angle to a plane perpendicular to a longitudinal axis of the channel. This covering of the cross-section means that, when projected onto a plane perpendicular to the longitudinal axis, the sealing element will at least substantially cover the cross-section of the channel so as to prevent access from outside the channel to the sound outputs of any of the sound generators.

This flexible element preferably spans a cross-section of the channel thus preventing moisture, dust and/or debris from entering the outputs of the sound generators while allowing sound there from to pass from inside the channel to outside the channel. The flexibility of the element is primarily defined by or required by the sound transmission capability, whereby a wide range of flexibility may be found suitable.

When the flexible element covers the cross-section of the channel and still extends at an angle to a plane perpendicular to the longitudinal axis, the surface of the flexible element (including any frame or holding element thereof) may be larger than the cross-section of the channel perpendicular to the longitudinal axis. This larger area will make it possible for the flexible element to better fulfill its sealing function, be able to block or take up more moisture/debris/dust while remaining sufficiently flexible to allow sound to pass. Preferably, the angle between a plane of the flexible element and the plane perpendicular to the longitudinal axis is as large as practically possible, such as 5 degrees or more, preferably 10 degrees or more, such as 15 degrees or more, preferably 20 degrees or more, such as 25 degrees or more, preferably 30 degrees or more, such as 35 degrees or more, preferably 40 degrees or more, such as 45 degrees or more, preferably 60 degrees or more.

In one embodiment, the sound generating means are elongated along a first direction, forming an elongated channel there between along the first direction. The channel-forming element has one or more side elements extending along the first direction and engaging one or more housings. The channel output is formed in one of the side elements. In this manner, the output is provided on a longitudinal side of the apparatus, which facilitates providing different outer dimensions of the apparatus than if the output was provided in the longitudinal direction.

In general, the channel-forming element may have outer wall parts which, in a cross-section, intersect with the outer periphery of the transducers, one or more of the wall parts then having an opening defining the output. In one embodiment, the channel-forming element is U-shaped and in another embodiment, the channel-forming element is, in a cross section, O-shaped or donut-shaped, where an opening may be formed in the cross-section or merely in a side portion. In general, the channel-forming element defines a hollow or concave shape in a cross-section, in which the hollowness or the concaveness provides inner surface part(s) which aid in defining the channel.

In one embodiment, two of the housings are positioned in a wedged arrangement, such as when viewing the outer dimensions of the apparatus, and wherein the channel defined also by the two housings is wedged. This wedged channel may have desired acoustic properties, and the wedged design of the apparatus may be especially adapted for particular purposes, such as the inner ear of a person.

In one embodiment, the output of the channel has a hollow element extending away from the housings and being adapted to provide an engagement with a sound receiving element. Thus, the output of the apparatus may be the hollow element, which additionally is adapted to engage another element, such as a tube adapted to transport the sound away from the apparatus. Another element to attach to the present apparatus may be an element adapted to fix the apparatus in relation to other elements, such as fitting the inner ear of a person.

Another embodiment further comprises a dividing element dividing the channel into at least a first and a second separate channel. The first channel connects the output of a first of the sound generating means and the output of the channel. The second channel connects the output of a second of the sound generating means and the output of the channel. In one situation, the dividing element functions to prevent sound emitted from one sound generator from directly impinging into the other sound generator. By keeping the sound from the generators separate until having left the channel, the intensity of sound from one generator finding its way to another sound generator may be kept sufficiently low.

This advantage may be seen if one generator is a woofer and the other a tweeter. The low frequency and normally high intensity woofer sound would easily distort the sound emitted from the tweeter, if this sound was allowed to enter the tweeter and act on the diaphragm of the tweeter.

In another situation, the generators may operate in the same manner, such as output the same sound. Also, in this situation, it may be desired that the sound from the generators is only mixed once outside the channel in that a better mixing may then be obtained.

In another embodiment, the apparatus further comprises a sound receiving element and processing means adapted to receive a signal from the sound receiving element and generate, on the basis of the first signal, one or more signals for the sound generating means. The sound receiving element is positioned in the channel. In one embodiment, the signal from the sound receiver, such as a microphone, is used for correcting the sound output from the sound generators. In general, this set-up makes the overall apparatus extremely compact.

In yet another embodiment, the apparatus further comprises a sound receiving element and first processing means adapted to receive a signal from the sound receiving element and generate data. The apparatus further comprises signal generating means adapted to provide signals to the sound generating means based on the data. In this situation, the data generated may be used as a calibration which is used subsequent to the data generation. Thus, the subsequent operation may not be an operation in which the sound receiving element is used and/or positioned in the channel.

In one embodiment, the apparatus further comprises an additional sound generating means positioned at least partly in the channel. Thus, this additional sound generating means may have a sound output opening into the channel or to the surroundings, if the sound output is positioned in or at the sound output of the channel.

In one situation, this apparatus further comprises a second channel-forming element, together with one or more surface parts of the additional sound generating means and of one or more of the sound generating means and/or the channel-forming element, a sound output of the additional sound generating means opening into the second channel. In this manner, the advantage of separate channels, as mentioned further above, is obtained in relation to this sound generating means.

In another aspect, the invention relates to an assembly comprising an apparatus according to the first aspect and a plurality of tuning elements each being adapted to be positioned within the channel. Each tuning element has different dimensions so that each tuning element is adapted to alter sound characteristics of the channel when positioned therein in different manners. Thus, the tuning elements preferably have the same outer dimensions, fitting within the channel, and different internal (surfaces within an outer circumference or circumscribed curve of the tuning element) dimensions in order to provide different acoustic filtering when positioned in the channel.

As mentioned above, the tuning element(s) may be removably fixable in the channel so that a tuning may be provided where different tuning elements are tested sequentially, until the desired tuning or sound is obtained.

These and other aspects of the present invention will become more apparent from the following detailed description of the preferred embodiments of the present invention when viewed in conjunction with the accompanying drawings.

BRIEF DESCRIPTION OF THE DRAWINGS

In the following, preferred embodiments of the invention will be described with reference to the following drawings.

DESCRIPTION OF THE ILLUSTRATED EMBODIMENTS

Figure 1:
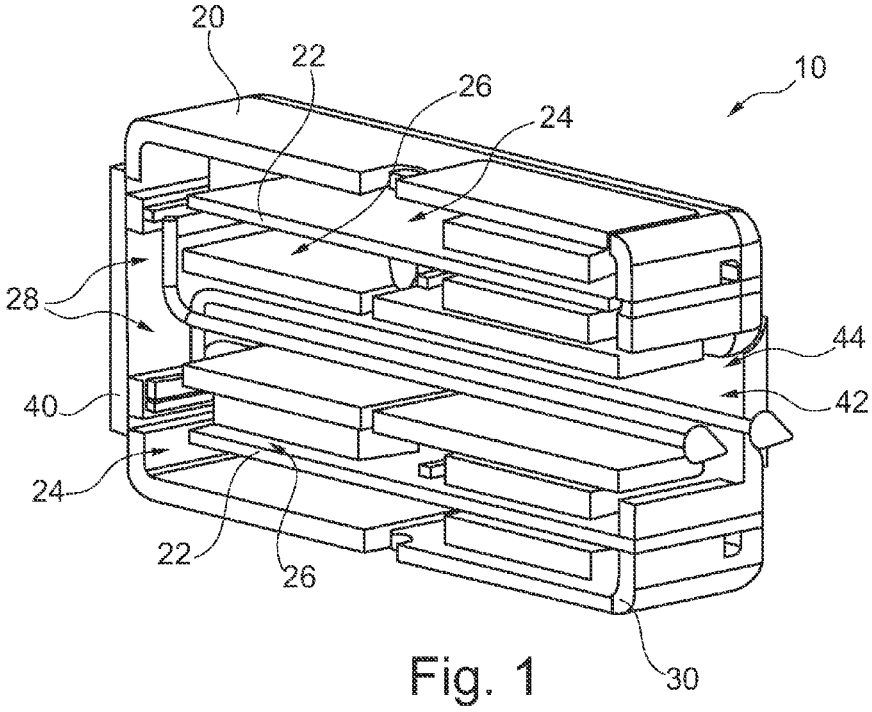
FIG. 1 illustrates a cross section first embodiment of the apparatus according to the invention.

In FIG. 1, an apparatus 10 is illustrated in which two hearing aid receivers 20 and 30 are fixed in relation to each other by a fixing element 40.

Each receiver 20/30 is, in this embodiment, identical and has a diaphragm 22 attached to a yoke and driven by a motor system comprising a coil and one or more permanent magnets. A receiver of this type may be seen, for example, in US Publication No. 2008/0063223, which is herein incorporated by reference in its entirety.

As usual, the diaphragm 22 divides the interior space of the receiver 20/30 into a back chamber 24 and a front chamber 26, and a sound output 28 is provided between the front chamber 26 and an exterior of the housing of the receiver 20/30.

The receivers 20/30 are positioned and fixed by the channel-forming element 40 with a predetermined distance there between, so that the outputs 28 open into a channel 42 provided by the channel-forming element 40 and the housings of the receivers 20/30.

It is noted that even though the present embodiments are described in relation to a sound provider where sound is provided by the receivers 20/30 and output via the channel 42, the opposite sound direction is equally possible, where the elements 20/30 are microphones.

Also, as will be made clear further below, the receivers 20 and 30 need not be identical. A number of advantages exist when different types of receivers or receivers with different properties are used.

In the present assembly, the dimensions, i.e. the distance between the housings of the receivers 20/30 and the width and length of the housings, will define acoustic properties of the channel and may easily be varied, as will be described further below, if desired.

Also, the positions of the outputs 28 in relation to the channel 42 as well as the position of the output 44 may be varied in order to, for example, obtain desired acoustic properties of the channel 42 or desired dimensions or uses of the assembly 10.

Figure 2:
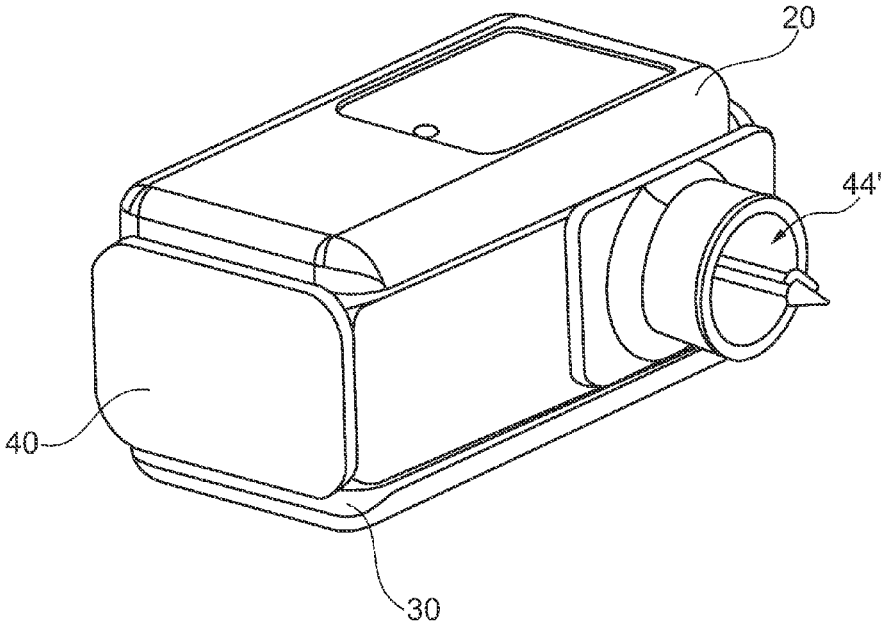
FIG. 2 illustrates an output positioned at a side.

In FIG. 1, the output 44 of the channel 42 is positioned at the end of the channel 42 opposite to the outputs 28, and in FIG. 2, the output 44' is positioned in a side portion of the channel 42. This both changes the acoustic properties of the channel 42 and facilitates the use of the assembly 10 in a rotated manner compared to FIG. 1.

An alternative would be to provide the outputs 28 not directly into the channel 42 but in a back housing part of the housing (pointing in the opposite direction of the output 44), whereby the channel-forming element 40 is shaped to direct sound from the outputs 28 into the channel 42.

Figure 3:
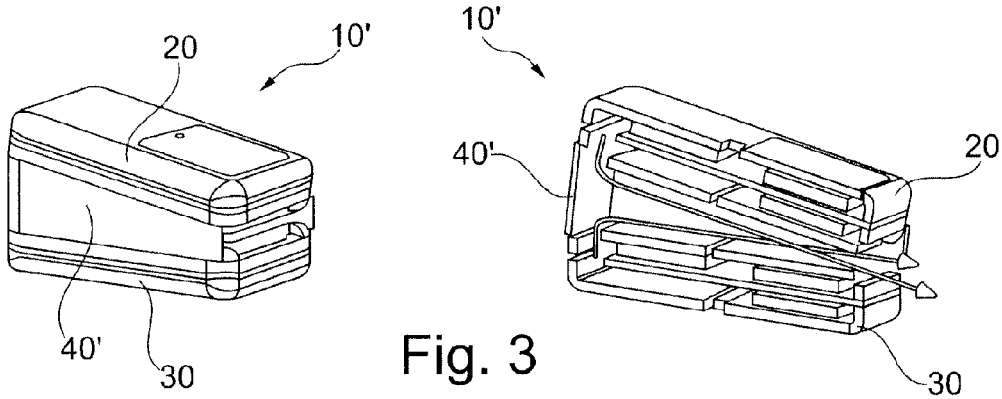
FIG. 3 illustrates a wedged embodiment.

Another alternative apparatus 10' is illustrated in FIG. 3, wherein the channel-forming element 40' fixes the receivers 20/30 in an angled manner so that an overall wedged set-up is obtained. Again, this provides certain acoustic properties of the channel 42 as well as provides the apparatus 10' with a shape useful in particular systems for use in the ear canal of a person.

Figure 4:
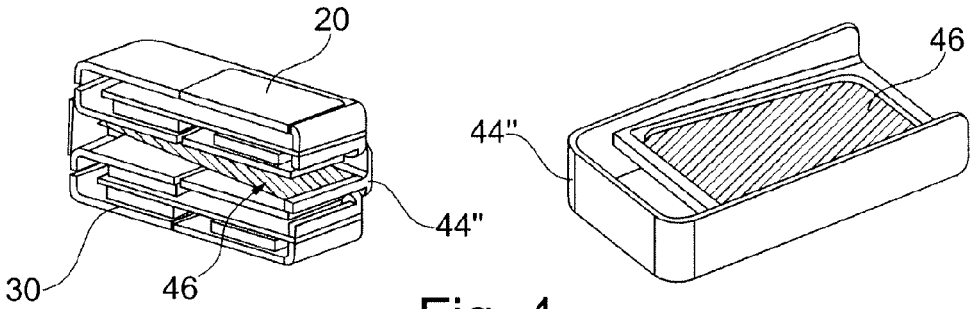
FIG. 4 illustrates the use of a flexible element.

Especially when used in the ear canal of a person, substances such as ear wax and sweat may cause problems by entering and clogging the output 44 or the channel 42. A way of avoiding this problem is illustrated in FIG. 4, wherein the fixing element 44" has a flexible element, such as a membrane 46', which spans the cross section of the channel 42 and thus prevents foreign elements, such as sweat and ear wax, from reaching the receivers 20/30 and/or clogging the channel 42. The membrane 46' is sufficiently flexible to allow sound to pass from one side thereof to the other while preventing passage of ear wax, water and the like.

In the assembly of FIG. 4, the membrane 46' is positioned at an angle to both the general direction of the channel 42 as well as a perpendicular direction thereto. In fact, the membrane 46' is provided with as large a surface as practically possible while still spanning the channel 42 and allowing the two outputs 28 to feed sound to the same side of the membrane 46'. The larger the surface of the membrane 46', the better the transmission of sound there across due to the longer span of the membrane 46'.

Figure 5:
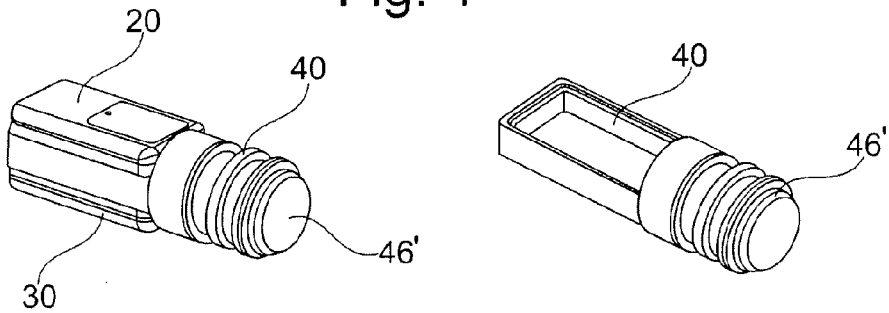
FIG. 5 illustrates a channel-forming element with a fixing element.
Figure 5:
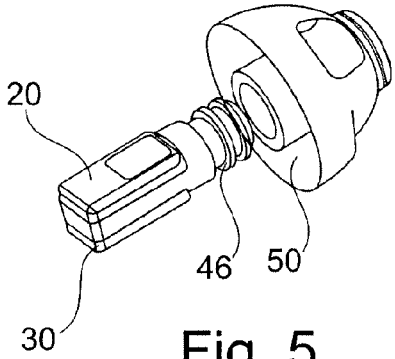

The channel-forming element 40 may be used, as is illustrated in FIG. 5, for additional purposes, such as the fixing of the apparatus 10 to other elements, such as a dome 50 for fixing the apparatus 10 to the ear canal of a person. The dome 50 may be fixed to a spout portion 46 of the channel-forming element 40 also forming the output 44 of the channel 42.

As mentioned above, advantages may be seen if different receivers 20/30 are used or when the receivers 20/30 are used for different purposes.

In one example, one of the receivers 20/30 may be a tweeter and the other a woofer, which may be obtained using identical receivers fed different signals or different receivers.

In this example, the sound output by the woofer is not desired in the tweeter, as the sound pressure of the woofer would, if impinging on the diaphragm of the tweeter, cause the tweeter to output distorted sound.

Even in the example of identical receivers 20/30 operated in an identical manner (receiving the same input), it may be desired to prevent sound output from one receiver directly into the other.

Figure 6:
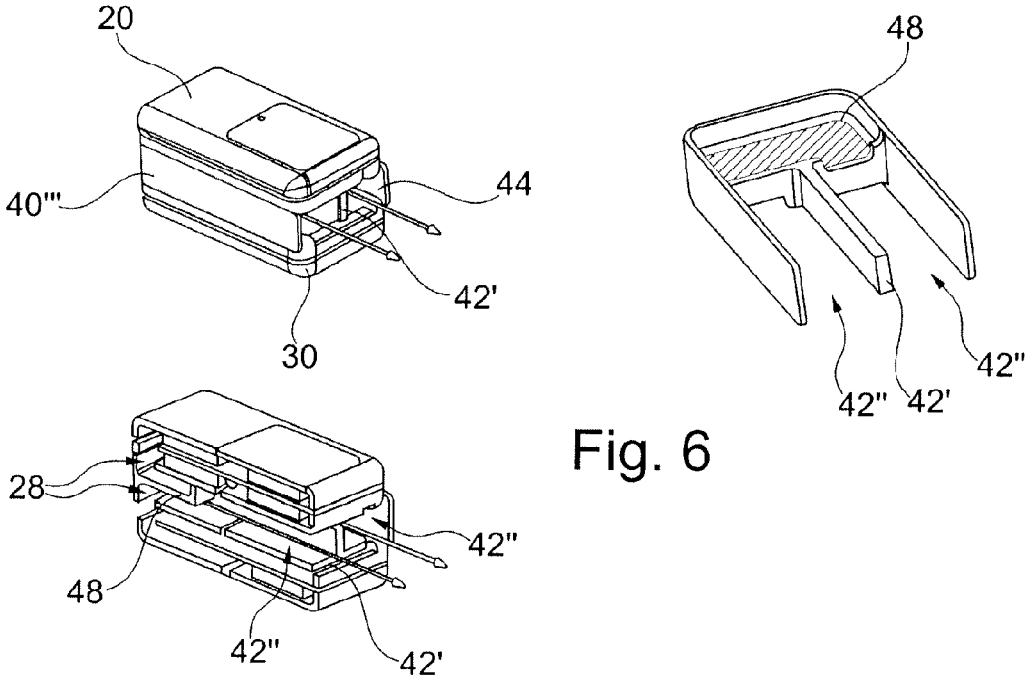
FIG. 6 illustrates a dual-channel set-up.

A solution to the above situations may be seen in FIG. 6, where the channel-forming element 40''' has the additional functionality of separating the sound output by the two receivers 20/30 until the sound has been emitted by the output 44. This is obtained by providing a dividing element 42' inside the channel 42, which element divides the channel 42 into two separated, parallel channels 42" and has, at the outputs 28, a directing element 48 directing the sound from each receiver 20/30 into a channel 42".

In this manner, sound from the receiver 20 can only impinge on the receiver 30 after having exited the output 44, which normally is not seen as a problem.

Figure 7:
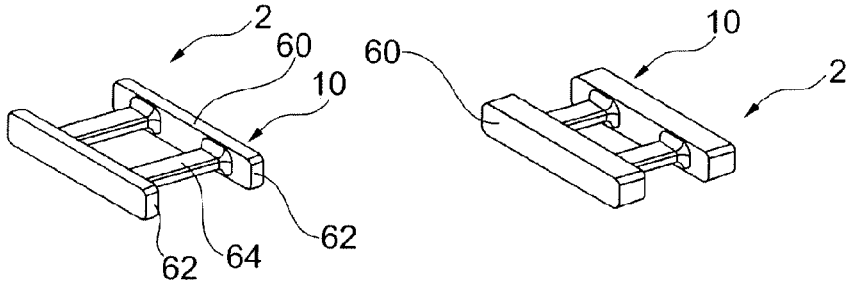
FIG. 7 illustrates the use of a tuning element.
Figure 8:
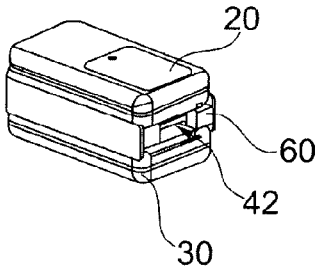
FIG. 8 illustrates a microphone positioned in the channel.
Figure 8:
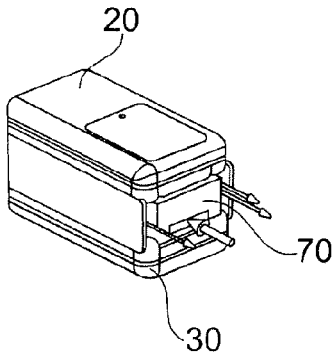

Another use of the channel 42 may be seen in FIG. 7, in which a tuning or changing of the acoustic properties of the channel 42 is illustrated and in which different tuning elements 60 are illustrated for introduction into the channel 42 for adapting the acoustic properties thereof and forming an assembly 2 of an apparatus 10 and a tuning element 60.

The two embodiments of the tuning element 60 has two side-bars 62 interconnected via connecting elements 64. The bars 62 effectively narrow the channel 42 and thereby alter the acoustic properties thereof. The two tuning elements 60 have the same overall outer dimensions to fit within the channel but different widths of the bars 62, whereby two different, effective widths of the channel 42 are obtained. It is seen that the height of the bars 62 correspond to a height of the channel 42, but a number of other dimensions may be selected in order to adapt the properties of the channel 42.

Another use of the channel 42 may be that of housing a microphone 70, such as a MEMS microphone, such as for monitoring the sound output by the receivers 20/30. This microphone 70 may output a signal received by a processor (not illustrated) which uses this signal to generate or adapt signals for the transducers 20/30. Thus, any effect of any change, aging, deposition/dust/moisture or the like may be taken into account.

Another reason for providing a microphone is for calibration of the sound providing assembly. In this situation, a predetermined signal may be provided to or by the receivers, and the output detected by the microphone 70. The signal output by the microphone 70 may be used for generating data, such as parameters or the like, which are subsequently used for adapting signals to be fed to the receivers. In this manner, the microphone 70 need not be present in normal operation. Thus, the generated data may be stored in relation to the receivers and be used for pre-processing circuitry provided for providing signals to the receivers.

Figure 9:
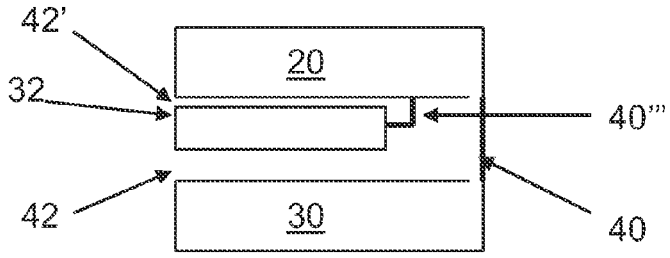
FIG. 9 illustrates an embodiment comprising three receivers.

FIG. 9 illustrates an embodiment comprising three receivers, 20, 30 and 32, where the receivers 20 and 30 are provided in the manner described above, and where the receiver 32 is provided in the channel 42.

The channel 42 is defined by the receivers 20 and 30 as well as a channel-forming element 40—in addition to the receiver 32 and a second channel-forming element 40' which, together with the receivers 32 and 20, define another channel 42'.

In this manner, the receiver 32 may be provided with its own channel 42', which may be an alternative manner of providing the separation described in relation to FIG. 6. Consequently, the receiver 32 may be a tweeter, where the receivers 20 and 30 may be used for providing lower frequency sound. Using the channel 42', the opening of the receiver 32 may be positioned inside the channel 42'.

In an alternative embodiment, the channel-forming element 40''' is not used, and the sound output of the receiver 32 may be opening into the channel 42 or directly to the surroundings through the output 44 of the channel 42.

Figure 10:
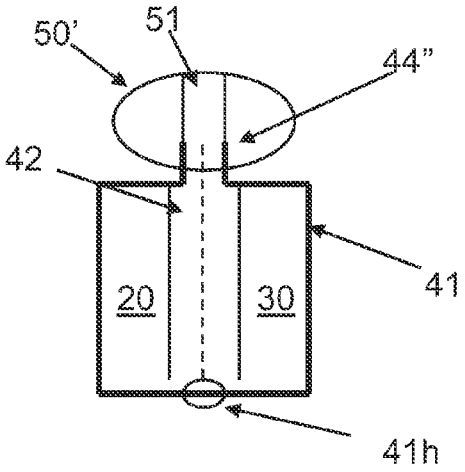
FIG. 10 illustrates an alternative embodiment.

FIG. 10 illustrates another manner of providing a channel-forming element 41. In this embodiment, the channel-forming element 41 is provided as a closeable shell having two housing parts hingedly fixed to each other at a hinge 41*h*. Within each housing half, a receiver 20/30 may be fixed to have the desired relation to each other defining the channel 42 with the desired dimensions.

In order to maintain the housing 41 closed, the output is shaped as a spout 44' divided into two halves, where each half is attached to a housing half. Thus, when closing the housing 41, the spout 44' is formed, which may be provided in a channel 51 of an external member 50', so as to lock the two housing halves together. This external member 50' may be as the dome 50 described in relation to FIG. 5.

Naturally, in all of the above embodiments, the receivers 20, 30, 32 may be removably attached to the channel-forming element 40/40'/41 in any desired manner, such as by using engaging protrusions on the elements.

Also, the membrane 46, channel 42' and turning element 60 may be combined with the channel-forming elements to form monolithic elements handling both operations and thus reducing the number of parts required to form the overall assembly.

Figure 11:
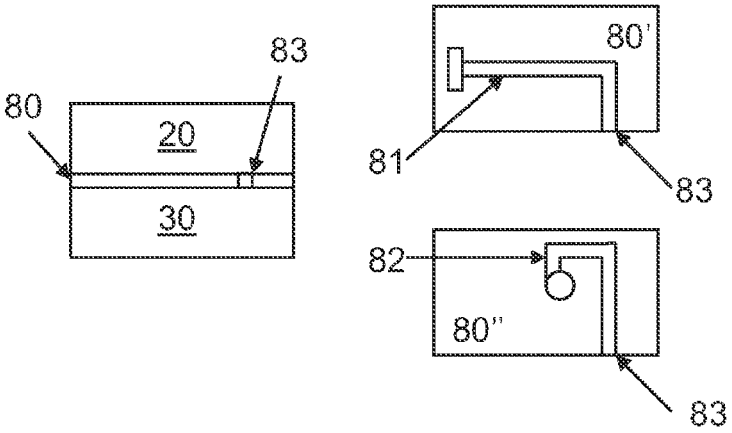
FIG. 11 illustrates an aspect in which a common vent is provided between two receivers.

FIG. 11 illustrates another aspect of the invention in that between the two receivers 20/30, a venting element 80 is provided.

In this aspect, the outputs of the receivers 20/30 may be directed in any direction and any type of channel-forming element, tubing or the like may be used.

Venting of receivers is usual, as the ambient pressure of a person and the receiver will vary for a number of reasons, such as when traveling in an elevator or when entering an airplane. In these situations, the receiver will, if not vented or pressure equalized, experience much the same problems as a human ear will, and the venting prevents this in the same manner as pressure equalizing (such as when swallowing) does for humans.

In receivers where the front chamber directly outputs sound to the surroundings, venting of the front chamber is not required as this always will be at the ambient pressure. The back chamber, however, requires pressure equalization. Hitherto, this has been obtained using a narrow hole or passage between the back chamber to the surroundings or to the front chamber.

When a barrier is used, as the above barrier for preventing humidity/sweat/ear wax from entering the receiver, this barrier may also prevent pressure equalization of the front chamber. Thus, also the front chamber may require pressure equalization.

Often, a venting hole is provided in the receiver between the front chamber and the back chamber, such as through the diaphragm of the receiver, so that only a single vent is normally required to the exterior of the receiver.

According to the present aspect, an intermediate venting element 80 is provided between the receivers 20/30, the venting element having a vent 83 connecting the back/front chamber of the receivers 20/30 with the surroundings.

It is desired that the venting of the receivers has no audio output. This venting is often denoted a DC venting. Thus, the vent channel or opening is selected sufficiently narrow for air/gas to pass but so that no audible frequencies are supported.

In one situation, it is desired to vent the front chambers of the receivers 20/30. Then, a venting element 80' may be used which has a channel 81 formed therein from the vent 83 to an opening positioned adjacent to either the sound outputs of the receivers 20/30 or openings through the housing of the receivers 20/30 into the front chambers.

In the situation where venting is desired to the back chambers, a venting element 80" may be provided having a channel 82 between the vent 83 and a position where openings through the housings of the receivers 20/30 open into the back chambers.

Naturally, the channels 81/82 may be cut-away portions (extending from surface to surface) of the venting elements 80/80'/80" or may be formed within the venting elements and only reach the surface at the vent 83 and at the other end of the channel in order to open into the front/back chambers.

This set-up has the advantage that the acoustic properties of the vent are easily altered or determined and that two receivers 20/30 may be vented using the same element.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

The invention claimed is:

1. An apparatus for outputting sound, the apparatus comprising:

a first sound generating means having a first housing, a first sound output, a first diaphragm and a first means for driving the first diaphragm on the basis of a received signal, a second sound generating means having a second housing, a second sound output, a second diaphragm and a second means for driving the second diaphragm on the basis of the received signal, a channel forming element having one or more surface parts defining, together with one or more outer surface parts of the housings of the sound generating means, a channel having an output, the sound outputs being positioned so as to open into the channel, wherein the channel is oblong, the sound outputs and the channel output being positioned on either side of a middle of the channel along a longitudinal axis thereof.

2. The apparatus according to claim 1, further comprising a tuning element adapted to be positioned within the channel, the tuning element being adapted to alter sound characteristics of the channel when positioned therein.

3. The apparatus according to claim 1, wherein the channel has a cross-section, the apparatus further comprising a sealing element comprising a flexible element, the sealing element covering the cross-section of the channel and the flexible element extending at an angle to a plane perpendicular to a longitudinal axis of the channel.

4. The apparatus according to claim 1, wherein the sound generating means are elongated along a first direction, forming the channel there between along the first direction, and wherein the channel forming element has one or more side elements extending along the first direction and engaging one or more housings, the channel output being formed in one of the side elements.

5. The apparatus according to claim 1, wherein two of the housings are positioned in a wedged arrangement, and wherein the channel defined also by the two housings is wedged.

6. The apparatus according to claim 1, wherein the output of the channel has a hollow element extending away from the housings and being adapted to provide an engagement with a sound receiving element.

7. The apparatus according to claim 1, further comprising a dividing element dividing the channel into at least a first and a second separate channel, the first channel connecting the first output of the first sound generating means and an output of the channel, and the second channel connecting the second output of the second sound generating means and the output of the channel.

8. The apparatus according to claim 1, further comprising a sound receiving element and processing means adapted to receive a signal from the sound receiving element and generate, on the basis of the first signal, one or more signals for the sound generating means, the sound receiving element being positioned in the channel.

9. The apparatus according to claim 1, further comprising a sound receiving element and first processing means adapted to receive a signal from the sound receiving element and generate data, the apparatus further comprising signal generating means adapted to provide signals to the sound generating means based on the data.

10. The apparatus according to claim 1, further comprising a third sound generating means positioned at least partly in the channel.

11. The apparatus according to claim 10, further comprising a second channel forming means element defining, together with one or more surface parts of the third sound generating means and of one or more of the first or second sound generating means, a second channel, wherein a sound output of the additional sound generating means opens into the second channel.

12. An assembly comprising an apparatus according to claim 1 and a plurality of tuning elements each being adapted to be positioned within the channel, each tuning element having different dimensions so that each tuning element is adapted to alter sound characteristics of the channel when positioned therein in different manners.

13. An apparatus for receiving sound, the apparatus comprising:

a first sound detector having a first housing, a first sound input, a first diaphragm, and a first means for detecting movement of the first diaphragm and outputting a corresponding signal;

a second sound detector having a second housing, a second sound input, a second diaphragm and a second means for detecting movement of the second diaphragm and outputting a corresponding signal;

a channel forming element having one or more surface parts defining, together with one or more outer surface parts of the housings of the sound detectors, a channel having an input, the sound inputs being positioned so as to open into the channel; and wherein the channel is oblong, the sound inputs and the channel input being positioned on either side of a middle of the channel along a longitudinal axis thereof.

14. The apparatus according to claim 13, further comprising a tuning element adapted to be positioned within the channel, the tuning element being adapted to alter sound characteristics of the channel when positioned therein.

15. The apparatus according to claim 13, wherein the channel has a cross-section, the apparatus further comprising a sealing element comprising a flexible element, the sealing element covering the cross-section of the channel and the flexible element extending at an angle to a plane perpendicular to a longitudinal axis of the channel.

16. The apparatus according to claim 13, wherein the sound detectors are elongated along a first direction, forming the channel there between along the first direction, and wherein the channel forming element has one or more side elements extending along the first direction and engaging one or more housings, the channel input being formed in one of the side elements.

17. The apparatus according to claim 13, wherein two of the housings are positioned in a wedged arrangement, and wherein the channel defined also by the two housings is wedged.

18. The apparatus according to claim 13, further comprising a dividing element dividing the channel into at least a first and a second separate channel, the first channel connecting the first input of the first sound detector and an input of the channel, and the second channel connecting the second input of the second sound detector and the input of the channel.

19. An assembly comprising an apparatus according to claim 13 and a plurality of tuning elements each being adapted to be positioned within the channel, each tuning element having different dimensions so that each tuning element is adapted to alter sound characteristics of the channel when positioned therein in different manners.

* * * * *